United States Patent [19]

Juriss et al.

[11] 4,012,882

[45] Mar. 22, 1977

[54] STRUCTURAL BUILDING PANELS

[75] Inventors: Ivan Bertram Juriss; Roger Douglas Hay; Andrew Culross Goodfellow; Thomas Townson; Keith Eric Hay, all of Auckland, New Zealand

[73] Assignee: Industrialised Building Systems Limited, Auckland, New Zealand

[22] Filed: Apr. 19, 1973

[21] Appl. No.: 352,749

[30] Foreign Application Priority Data

Apr. 19, 1972 New Zealand ..... 166928
Nov. 22, 1972 New Zealand ..... 169085

[52] U.S. Cl. ..... 52/615; 428/73; 52/127; 52/272

[51] Int. Cl.[2] ..... E04C 2/36; E04B 2/10

[58] Field of Search .... 52/668, 615, 586, 578–582, 52/615, 400, 272; 161/68, 69; 428/73

[56] References Cited

UNITED STATES PATENTS

| | | | |
|---|---|---|---|
| 1,733,966 | 10/1929 | Irving | 52/668 |
| 1,997,996 | 4/1935 | Carstens | 156/304 |
| 2,108,479 | 2/1938 | Elmendorf | 52/668 |
| 2,140,772 | 12/1938 | Slayter et al. | 52/586 |
| 2,218,465 | 10/1940 | Gunnison | 52/586 |
| 2,299,614 | 10/1942 | Deutsch | 161/69 |
| 2,363,405 | 11/1944 | Eichelberger | 52/586 |
| 2,479,342 | 8/1949 | Gibbons et al. | 161/36 |
| 2,540,468 | 2/1951 | Anderson | 52/585 |
| 2,961,478 | 11/1960 | Burns | 52/586 |
| 3,074,123 | 1/1963 | Gartrell | 52/586 |
| 3,464,170 | 9/1969 | Grover | 52/580 |

FOREIGN PATENTS OR APPLICATIONS

| | | | |
|---|---|---|---|
| 167,645 | 5/1956 | Australia | 52/615 |
| 628,338 | 5/1963 | Belgium | 52/615 |
| 639,095 | 3/1962 | Canada | 52/400 |
| 675,989 | 12/1963 | Canada | 52/615 |
| 681,238 | 3/1964 | Canada | 161/69 |
| 914,436 | 6/1946 | France | 52/582 |
| 1,330,703 | 5/1963 | France | 52/578 |
| 556,460 | 10/1943 | United Kingdom | 52/615 |
| 613,127 | 11/1948 | United Kingdom | 52/615 |
| 702,880 | 1/1954 | United Kingdom | 52/615 |

*Primary Examiner*—James L. Ridgill, Jr.

[57] ABSTRACT

A structural building panel in which there is a core consisting of two sets of strips which cross each other and a pair of skins on either side of the core, with the scale of the cells being between a minimum of 12 inches square with ⅜ inch webs and a maximum of a depth of 12 inches before buckling occurs in the webs so that for a skin thickness of ⅜ inch, a cell width of 21 inches is possible before buckling occurs in the skin, the webs and skins being selected from plywood, veneer board, particle board and fiber reinforced cementitious materials. The webs are preferably bonded one to the other at junctions thereof. The panels are preferably joined to each other by trapezoidal grooves in which a shaped member is fixed.

8 Claims, 30 Drawing Figures

STRUCTURAL BUILDING PANELS

BACKGROUND OF THE INVENTION

This invention relates to structural building panels and has been devised particularly though not solely as a structural building panel for use as a structural wall, floor or roof member.

There exists a need for a building panel for use as a rigid and stable load bearing wall, floor or roof member which is light in weight, economic in use of materials and in method of manufacture, which may be manufactured from commonly available material, yet capable of being constructed in any convenient size, and also capable of being varied internally to suit the loads and the manner of use required for the position in the building envisaged, without fundamental alteration to its external appearance or geometry, other than its dimensions. Such a construction is advantageous when a building is prefabricated in a factory, allowing the construction of structural members of a building by the same basic method, regardless of the size of such members.

PRIOR ART

In the past, building panels have commonly been made in the form of a sandwich, consisting of a core member and a pair of continuous outer skins, with or without a frame which may carry part of the load of the panel. Such panels have hitherto been limited by the methods of assembly, the structural properties or the economy, for example, a. The panel size is usually restricted to a maximum of 8 feet by 4 feet when the panel must be assembled with the use of a hot press which is commonly a maximum size of 8 feet by 4 feet, and b. When a panel is used as a floor or roof member, the span over which the panel may be used is limited because of the shear strength of the core member and with the core member construction as at present in use, the span is generally limited to approximately 8 feet.

c. When a building panel is produced where the core member is of adequate strength in shear for use as a floor or roof member, it is generally uneconomical when used as a wall member or the nature of the core member in such that it cannot be varied at specific points in order to take care of concentrated loads at these specific points.

OBJECTS AND SUMMARY OF THE INVENTION

It is therefore an object of the present invention to provide a structural building panel to be used as a floor, roof or wall member in a prefabricated building which will overcome or minimize the foregoing disadvantages in a simple yet effective manner or which will at least provide the public with a useful choice.

Accordingly in one aspect, the invention consists in a structural building panel comprising a core and a pair of continuous skins, one skin being fixed to each side of said core member, said core member comprising a plurality of strips of suitable material placed so that the edges of each strip are fixed one to each skin and said strips are arranged in two sets, each strip and each set being substantially parallel with each other, and each set being arranged to lie at a suitable angle to said other set, providing that the angle of one set with the other set is such that one set retains the other set substantially normal to the skin of the panel before and during fixing of the skin to the core.

One preferred form of the invention will now be described with reference to the accompanying drawings in which,

Figure 1:
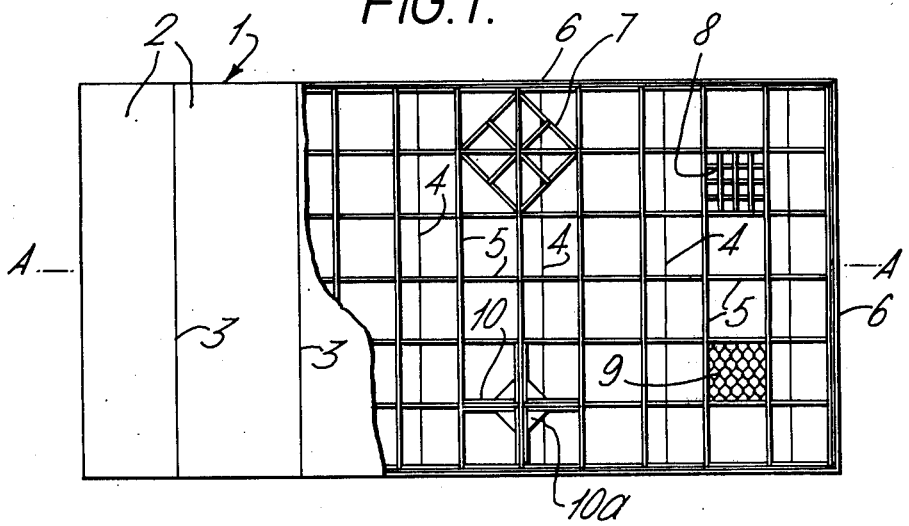
FIG. 1 is a plan view of a typical structural building panel with the top skin partly removed to show the core construction.
Figure 2:
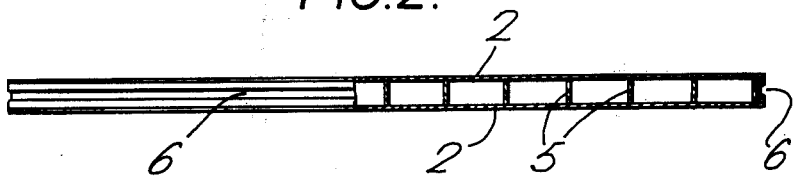
FIG. 2 is a view in part elevation of the edge of the panel of FIG. 1 and a part section on the line A—A FIG. 1.

Referring to the drawings a preferred form of panel is constructed as follows:

DETAILED DESCRIPTION OF THE INVENTION

Figure 3:
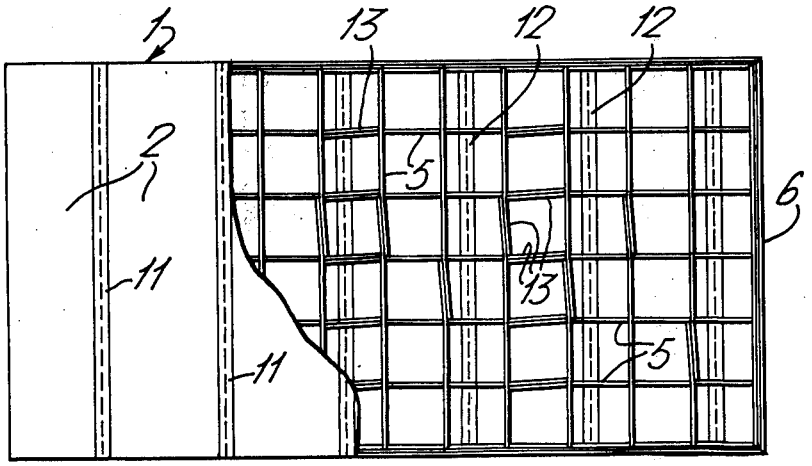
FIG. 3 is a plan view of a typical panel as shown in FIG. 1 but showing alternative constructions.

The panel 1 is made of typical size for example 3,600 mm by 7,200 mm with core members in a square of 600 mm by 600 mm. An upper skin 2 has joints 3 and a lower skin has corresponding joints 4. Intersecting core members 5 are provided and in the example described are of 10 mm plywood and the panel is provided with edge members 6. Diagonal reinforcing may be included as shown at reference 7 or an alternative form may consist of small "egg crate" members 8, again of 10mm plywood. A further alternative form of inserted reinforcing may consist of a cardboard honeycomb shown at 9 (FIG. 1) A still further alternative form of inserted reinforcing consists of timber members 10 glued to the sides of core members and timber blocks 10*a* at the corners. In FIG. 3 is an alternative construction in which the sheets defining the skin 2 are joined by being covered with a continuous strip of material 11 which may, for example, be also of 10mm plywood. Similar strips 12 are shown joining the lower sheet in the panel. To join the core members 5, lapped joints 13 glued or otherwise fastened may be provided and the use of this system of joining lengths of material to form the core members depends on the ability of the core member to bend its own thickness in the width of a cell.

Figure 4:
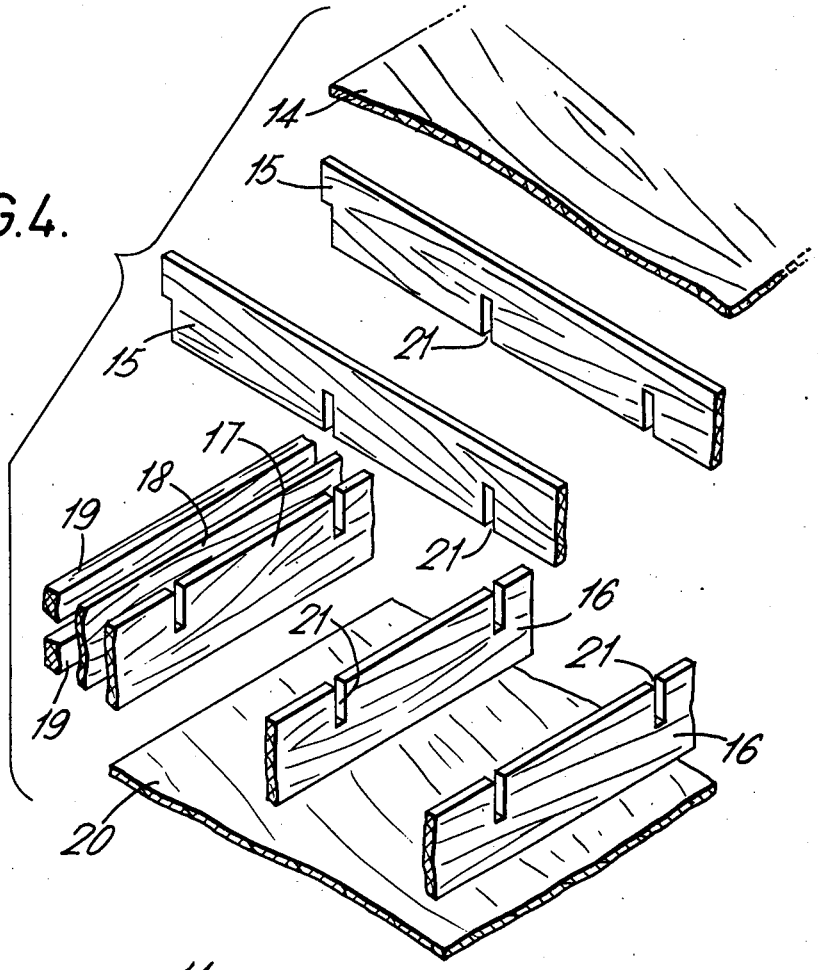
FIG. 4 is an exploded view of components of a structural building panel according to the invention shown in isometric projection.
Figure 5:
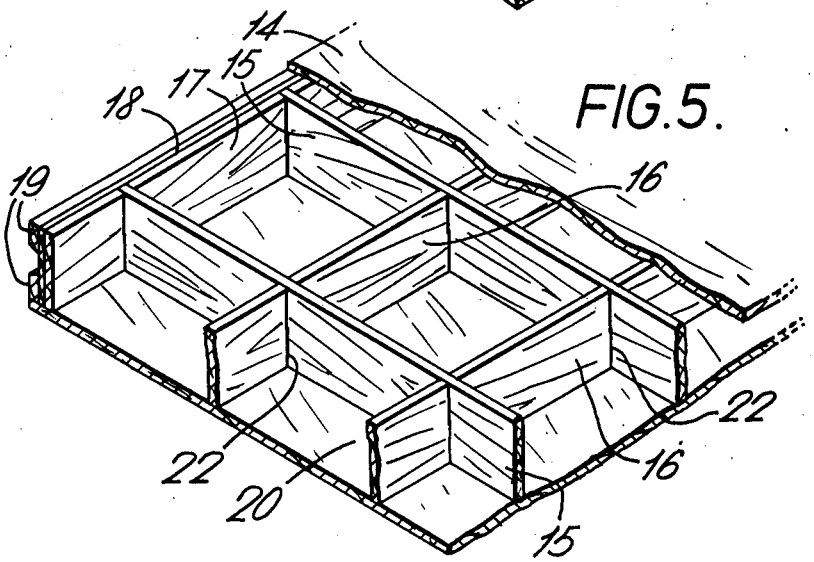
FIG. 5 is a part isometric view of a panel assembly according to the invention.

In FIG. 4 the components are of a panel as shown in isometric projection, with the upper skin being referenced 14, transverse ribs of the core referenced 15, longitudinal ribs referenced 16, inner edge members referenced 17, outer edge member referenced 18, timber members forming the edge profile being referenced 19 and the lower skin being referenced 20. Notches 21 are cut to half the depth of the rib members at intervals corresponding to spacing of the other set of rib members. In FIG. 5 the components shown in FIG. 4 are assembled with joints 22 between the rib members being made by slotting one set of rib members into the slot 21 of the other set. Although the sets of ribs are shown at right angles, other angles of intersection may be used.

Figure 6:
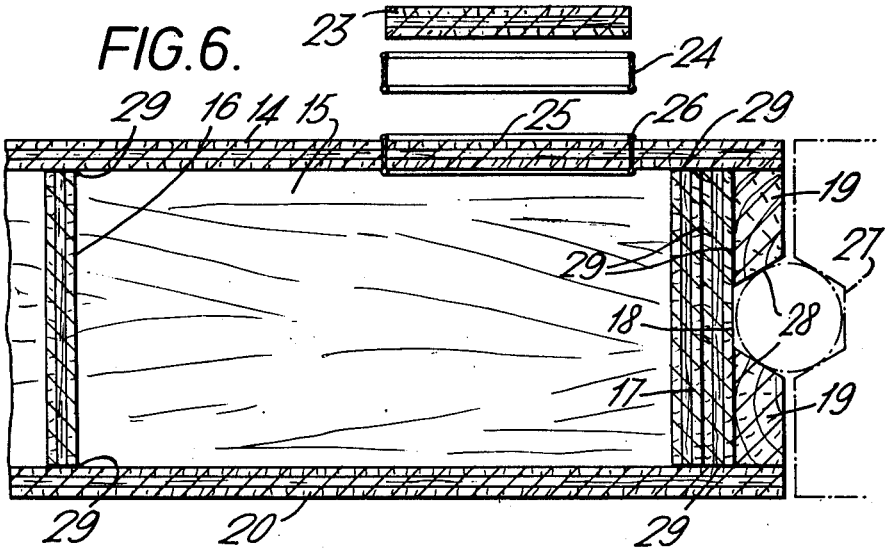
FIG. 6 is a detailed view in cross section of the edge of the panel of FIG. 5, FIGS. 7 and 8 show detailed plan views of the intersections of ribs with unglued and glued joints.

In FIG. 6 a detailed cross section of the edge of the panel is shown in which a disc section 23 is shown removed from the upper skin 14 where required for access to the panel jointing. An annular ring of neoprene extrusion forms a seal 24 to seal the disc when reinserted. The reinserted disc is referenced 25 and the inserted neoprene seal is referenced 26.

To join two panels together, a jointing member 27 e.g. a round tube is fitted between faces 28 of members 19 as will be referred to in more detail later. The planes of the faces 28 are arranged to be tangential to the tube 27 and are slightly crushed against the tube when a joint is fully tightened.

In FIG. 6 glue lines between various assemblies are shown as a heavy line referenced 29.

Figure 7:
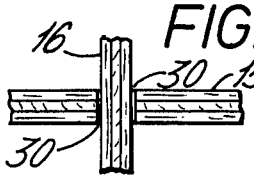
Figure 8:
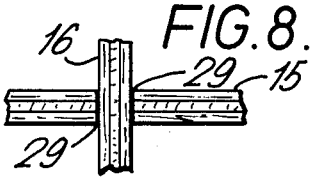

In FIG. 7 a pair of ribs 15 and 16 are shown with an unglued joint, the unglued contact face 30 lying against the face of rib 16. In FIG. 8 a glued joint is shown again with the glue line reference 29.

Figure 9:
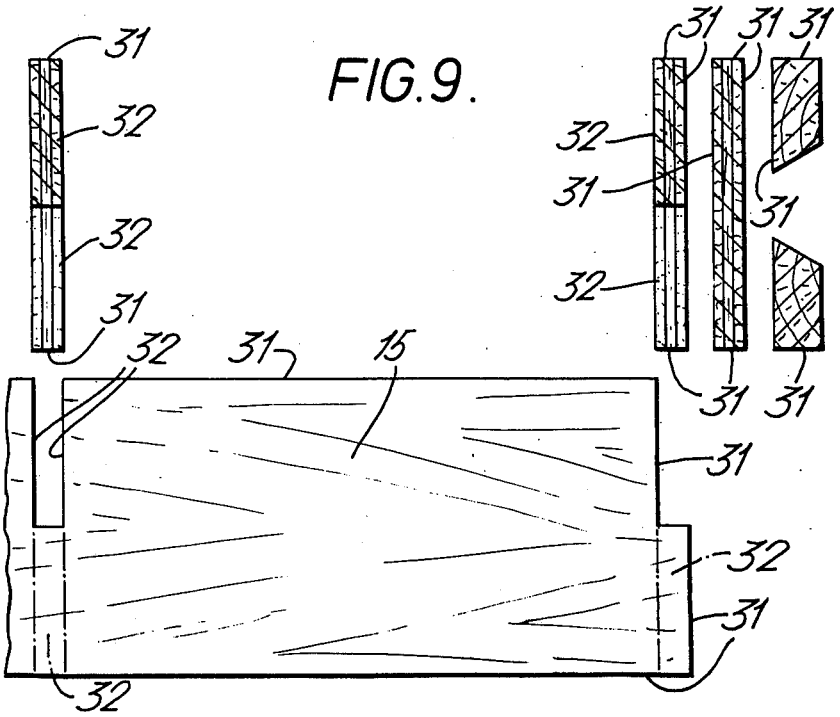
FIG. 9 is an exploded view of components shown in FIG. 6.

In FIG. 9 exploded components of the assembly shown in FIG. 6 have edges 31 which are surfaces which are always glued and surfaces 32 which usually remain unglued but are glued in the preferred form of the invention.

Figure 10:
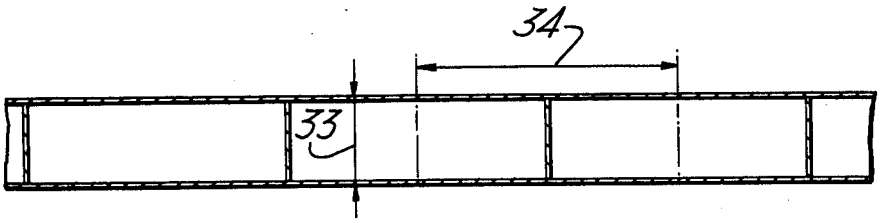
FIG. 10 is a view in diagrammatic section of parts of the panel.

In FIG. 10 a portion 34 of the panel skin is equivalent to the spacing of the cell ribs and this portion 34 may be taken as the flange portion of a beam for purposes of analysis with the beam having a depth 33 as shown in this figure.

Figure 11:
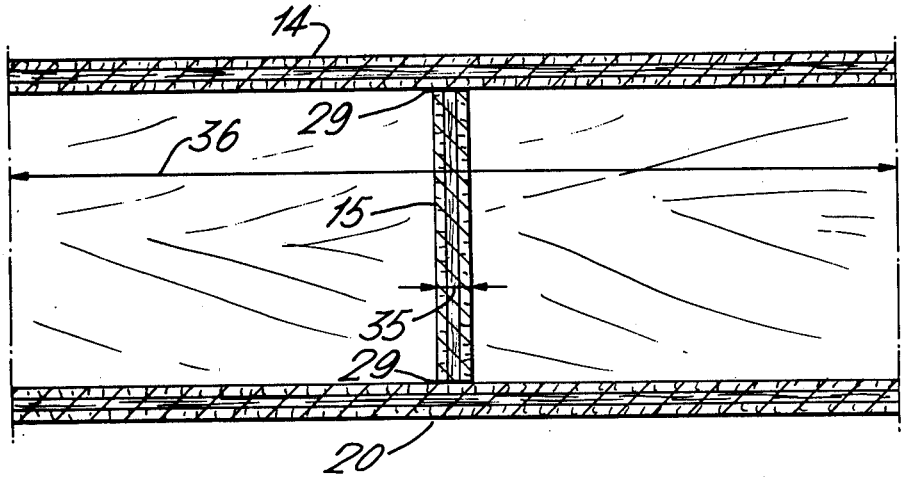
FIG. 11 is a view showing details to a larger scale of portions of the panel shown in section in FIG. 10.

In FIG. 11, the portion 34 of FIG. 10 is shown in an enlarged view with the length referencce 36 taken as being the portion of the skin taken as a flange of the beam and the web thickness 35 shows a typical relationship of the web thickness 35 to the flange width 36 and being of the order of 3:128.

Figure 12:
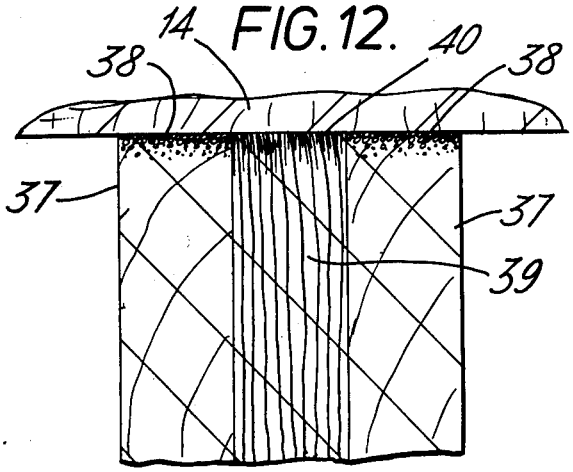
FIG. 12 is a detail view larger than full size of a junction of web members and flange members.

In FIG. 12 there is shown an enlarged portion of the junction of the web member and flange member with the veneer 37 of the web member running with fibers thereof parallel to the flange member. The glue line 38 is bonded to sides of fibers in the veneer 37 and the veneer 39 of the web member running perpendicular to the flange member has glue 40 drawn into ends of fibers of the veneer 39.

Figure 13:
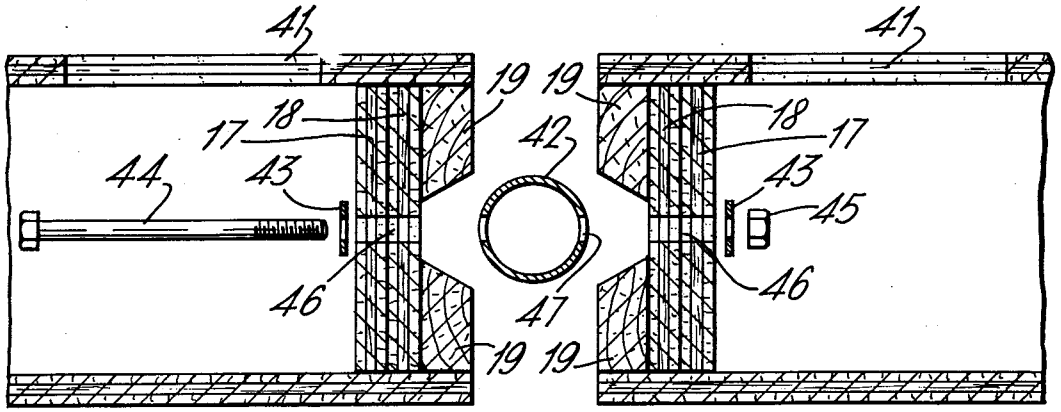
FIG. 13 is a detail view of a joint components between edges of panels.

In FIG. 13, the joint between edges of the panel is shown in more detail with a section or hole 41 cut in the skin for access to the joint. A tubular jointing member 42 has a transverse hole 47 therein though if the tubular member is in short lengths this through hole 47 may not be necessary, with a bolt 44 then passing adjacent one or each end of a length of tube. The bolt 44 passes through apertures 46 in the members 17 and 18 and washers 43 and 45 are provided.

Figure 14:
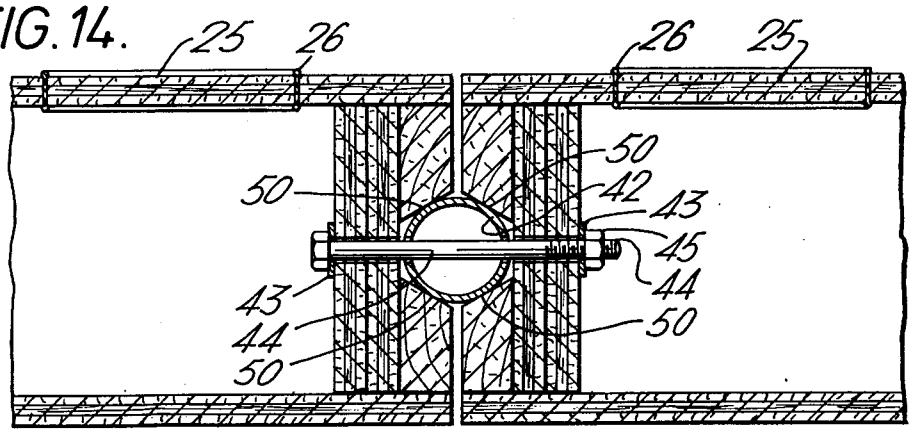
FIG. 14 is a view showing an assembled joint.

In FIG. 14, the joint is assembled and as mentioned above a portion 50 of the edge profile of the members 19 is in close tangential contact with the tubular member 42 with some crushing being desirable when the joint is pulled tight.

Figure 15:
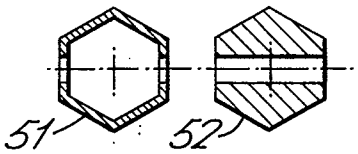
FIG. 15 is a view showing alternatives to the tubular member shown in FIGS. 13 and 14.

In FIG. 15 alternatives to the tubular members are shown comprising a hexagonal tubular member 51 or hexagonal solid member 52 and in both cases the edge profile at 50 in FIG. 14 is arranged to the be parallel to hexagonal surfaces at the bearing points shown. It is essential for proper bearing and alignment that the bearing on the surfaces take place before contact with the vertical surfaces of the edge profile recess i.e. as shown in FIG. 14.

Figure 16:
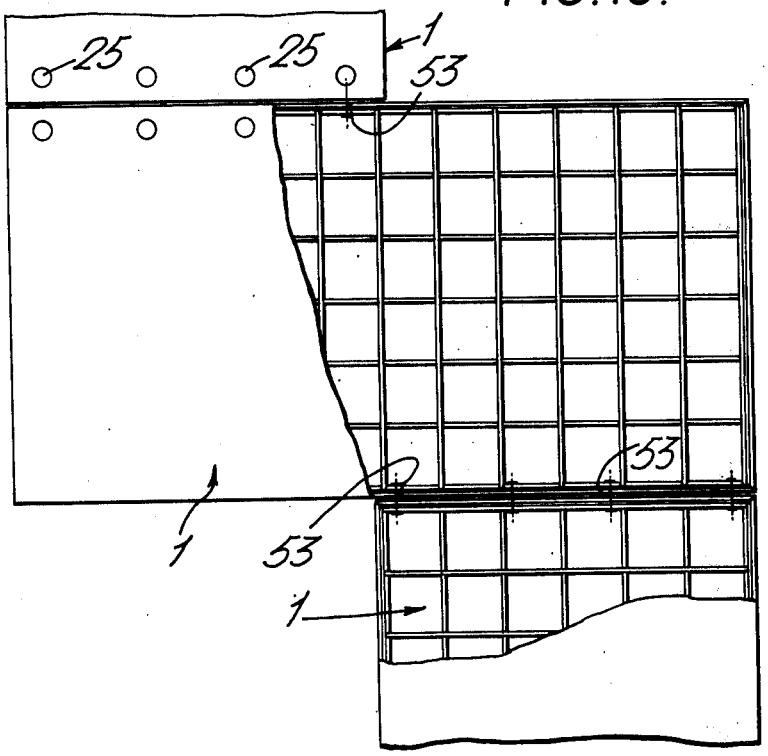
FIG. 16 is a plan view of assembled panels showing typical location of jointing means.
Figure 17:
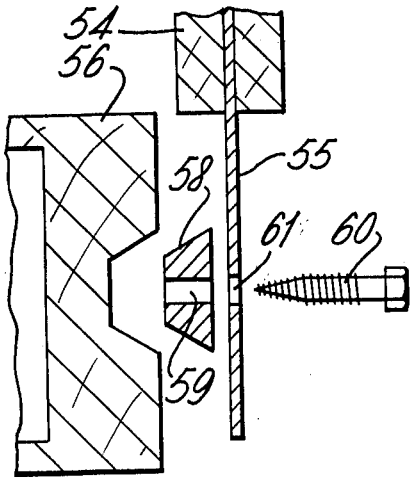
FIG. 17 is a view illustrating components for connecting wall panels or other panels which intersect with the plane of the panel according to the invention.
Figure 18:
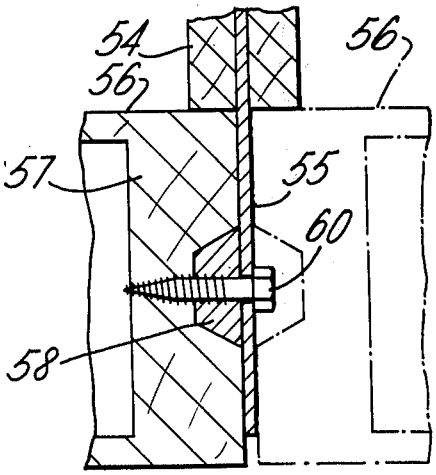
FIG. 18 is a view disclosing an assembled connection.

In FIG. 16, there is shown a plan of panels showing a typical location of jointing means and the jointing tubes are shown as short length 53 although if desired a continuous length could be provided. However, the use of short length of tube enables wall panels mentioned as shown in FIG. 17 and 18 to be placed in between the jointing positions. This also reduces contact area between the panel edges to increase the degree of interruption required for an acoustic isolation of one panel from the next. Thus referring to FIG. 17, a wall panel 54 has a tongue 55 embedded therein and protruding therefrom to engage with a floor or ceiling panel 56, a trapezoidal section key member, for example, of cast iron 58 is held to the tongue 55 by a lag screw or coach screw 60 passing through a hole 59 in the key member 58 and hole 61 in the tongue 55 to engage end plate 57 of the panel 56 as is shown in FIG. 18. It is to be noted that the member 58 is to be a tight fit into the groove in member 57 and that the holes 59 and 61 have to be a tight fit over screw 60. Screw 60 can also be replaced by the bolt and nut arrangement as in the assembly shown in FIG. 14. An adjacent panel can be fixed as shown in dash lines in FIG. 18 and the key member 58 can be made in two portions back to back so as to bear in both grooves of adjacent panels 56 again as shown in FIG. 15.

Figure 19:
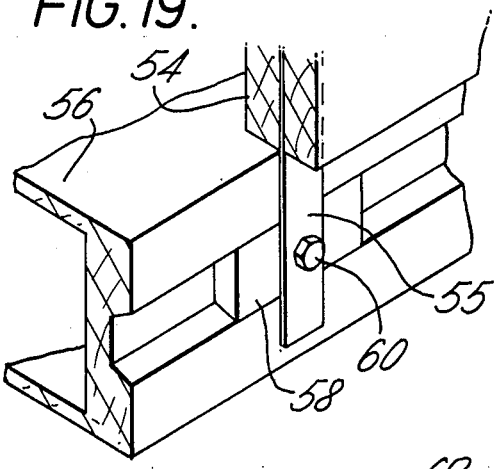
FIG. 19 is an isometric view of typical connections showing relative width of the tongue shown in FIGS. 18 & 19, FIGS. 20 and 21 are views showing alternative means of connecting panels with exploded components and assembled components respectively.
Figure 22:
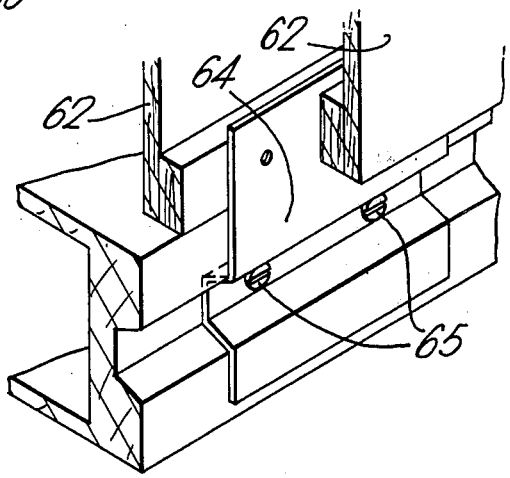
FIG. 22 is an isometric view of an assembled joint.

FIG. 19 is an isometric view of the assembly in FIG. 18 but with only one panel 56 showing the relevant dimensions of the tongue 55 to the key 58.

Figure 20:
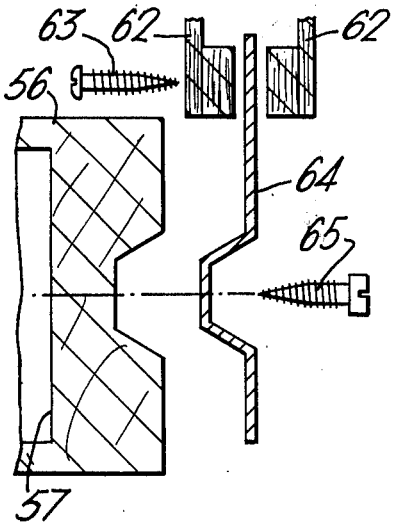
Figure 21:
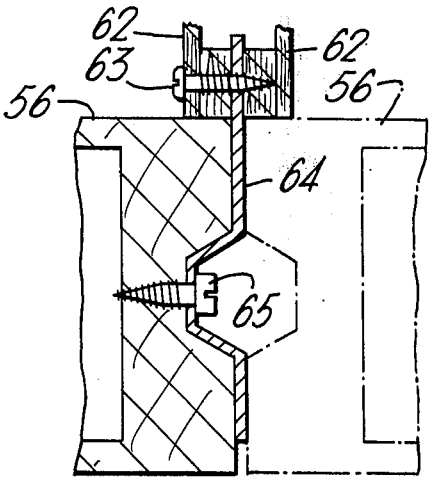

In FIG. 20, there is shown alternative means of making connections, the wall panel comprising two separate parts 62, a tongue 64 is provided as a loose tongue formed to the edge profile of the member 57 of the panel 56. The two parts 62 are held together and the tongue 64 fixed thereto by a screw 63 and a screw 65 fixes the tongue 64 to the member 57 of the panel 56 as may be seen in FIG. 21.

Figure 23:
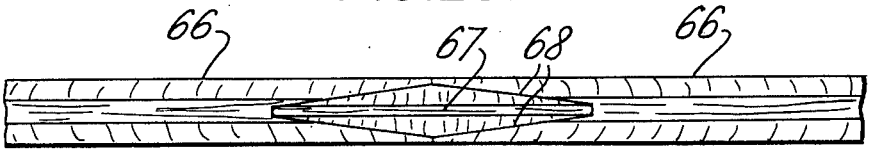
FIGS. 23 and 24 are view illustrating means of joining facing materials in skins of panels and an exploded view of the components respectively.
Figure 24:
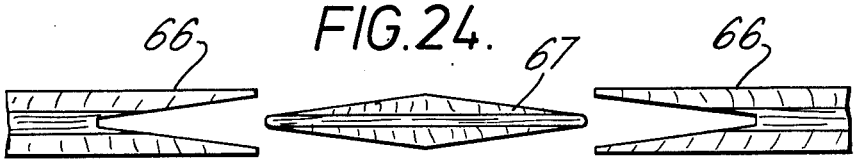
Figure 25:
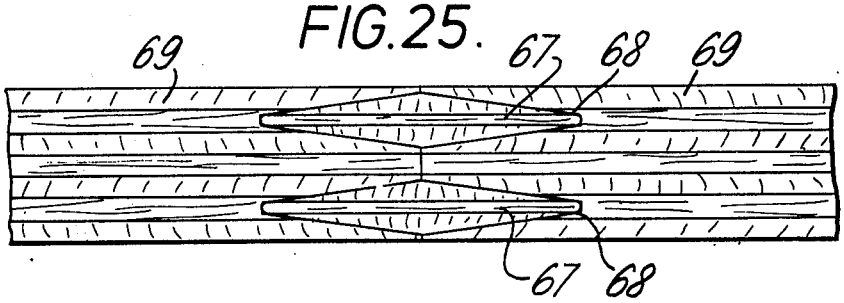
FIG. 25 is a view showing an alternative jointing means applied to thick skins.
Figure 26:
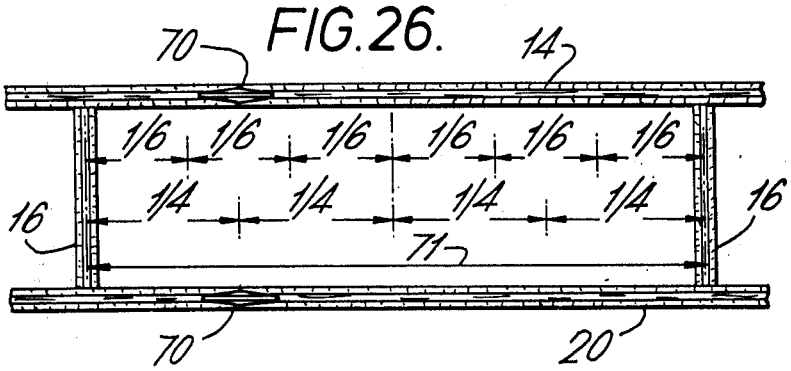
FIG. 26 shows location of joints in relation to web spacing
Figure 27:
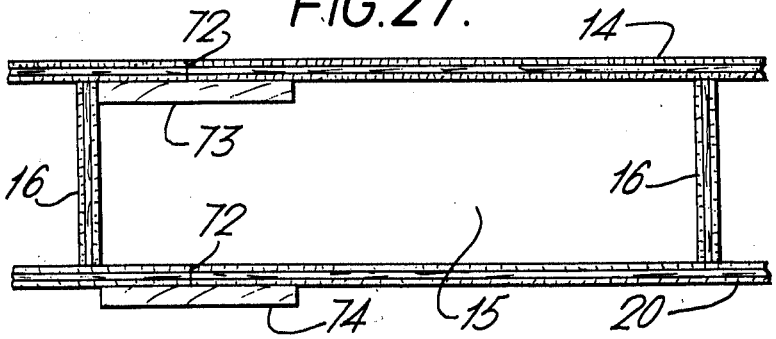
FIG. 27 is a view disclosing the alternative means of joining sheet materials.

In FIGS. 23 to 26 there is shown a preferred means and method of joining facing materials in the skins of the panels. FIGS. 23 and 24 show jointing of thinner panels and FIG 25 show the jointing of thicker panels. In FIG. 26 there is shown the location of panel joints relative to core members or ribs. Referring to these figures the skin 66 (consisting of three veneers) is provided with a V shaped slot in the end into which a feather 67, again preferably of three veneers is proportioned so as to obtain maximum contact area between parallel fibers, with the members being assembled with a glue line 68 as shown in the figures. The long edges of the sheet of plywood forming the skins are grooved in a double taper at a slope of 1 in 8. Thus to join a twelve foot by four foot sheet of scarfed plywood, the sheet is laid in place by hand with glue inserted in the groove, then the groove tongue is inserted then the next sheet of plywood with the glued groove put in place. This continues until the full skin is completed when pressure is applied to push all the joints tightly together at the same time as the vertical pressure as the whole width assembly. The edge joints are so positioned that they are carried between transverse ribs as there is more risk of such joint breaking over a rib than between the ribs. However, even though the joints are positioned between webs, the construction has the advantage that the sheets can be manhandled into place when the total assembly is made up, the joints do not require pressing themselves as the whole assembly because of wedging action of the tongue keeps the joints tight until the glue is cured and the geometry of the joint prevents them from coming apart. Also the slope of the glued surface develops the required strength in the skin across the joint. In FIG. 25 a skin of more than three veneers 69 can use either one larger feather or two double feathers 67 (as shown) again with the glue line 68 as shown above. In FIG. 26 there is shown the preferable position of a joint in the skin between one sixth and one quarter of the span between webs 16 i.e., approximately at the point of contraflexture of the skin bending. Thus the span of the web is referenced 71 and the spacings of one quarter and one sixth are shown in the figures with the joints positioned approximately at or between these positions. In FIG. 27 there is shown a further jointing method in which a glued butt joint 72 is provided with a reinforcing strip 73 placed over the joint with the reinforcing being placed internally where the outside of the skin is preferred to be uninterrupted. The reinforcing strips 73 may be placed either as short lengths between transverse ribs 15 or as continuous lengths with the transverse ribs 15 cut over the continuous length. At 74 there is shown an applied reinforcing strip on the outside of the skin.

It is a particular advantage of the invention that a panel constructed as described will maintain a very flat surface when erected in a horizontal plane even when fully loaded.

It is envisaged that ventilation passages may be provided between the cells of the cores by removing a small portion of each rib each side of each half check at the intersection of each set of ribs. Thus air may move from cell to cell and the cutaway portion acts as a lead in facilitating assembly of the ribs with each other.

Figure 28:
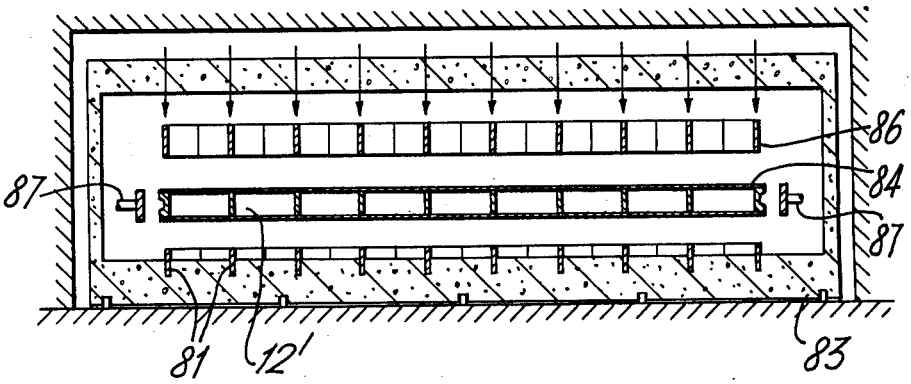
FIG. 28 is a view in diagrammatic cross section of a press according to the invention.
Figure 29:
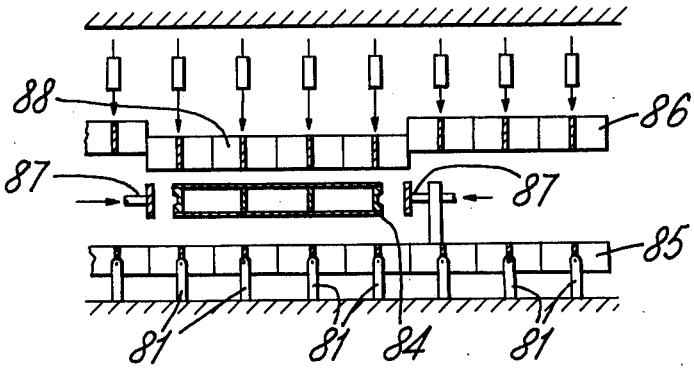
FIG. 29 is a view in part longitudinal section of the press of FIG. 28

A further advantage of the construction is that it is possible to construct panels of considerable size with the use of relatively low pressure on the lines of the ribs. Thus referring to FIGS. 28 and 29 a series of vertical rectangular frames 81 are set up one for each transverse rib up to, for example, a length of 24 feet. Each frame is wide enough for a twelve foot wide panel assembly 84 to be slid through. The top of each frame is a steel bar which is just wide enough, say 25 mm to exert pressure on the line of the bottom of the rib. Integral with these bars are short transverse bars 85 at spacings corresponding to the spacings of longitudinal ribs in the assembly so that the total assembly of the frames and bars forms a grid pattern corresponding to the grid pattern of the ribs inside the assembly. Above each frame is a cross shaped bar, each one corresponding to the rib junction inside the assembly. These are actuated mechanically or hydraulically to press down on the top of the assembly against the top girder of the frames. The control system would allow for either all or any selected pattern bars to be used, say bars 88 according to the width or length of the assembly being pressed. Accordingly, the top girder of each frame has to be sufficiently strong to take a variety of reactions according to the pressure being exerted. At the sides of each frame, further rams 87 are arranged pressed against the sides of the panel assembly at the same time the vertical pressure is applied.

The entire pressuure system is contained in a chamber 83 adapted to be supplied with heated dry air so that the temperature of the whole assembly is raised and the humidity kept low during pressing. Heating of the original glue lines to speed curing is achieved by heating the two grids of the bars. This is mostly achieved by making the bars a fixed assembly of hollow steel tubes filled with a liquid heating medium such as oil but versatility of this must be possible to vary the spacing of both sets of ribs. This would be done by placing the frames on a set of longitudinal tracks so that the spacing can be varied and making the transverse bars corresponding to the longitudinal ribs in a series of lengths which can be exchanged one for the other according to the spacing desired. In this case, some form of electric heating may be desirable. The ribs of the assembly may be glued up and put together outside the press and temporarily bound together by steel straps as in packing cases and then placed inside the press by a horizontal movement system.

The construction above described uses the unique property of plywood in panel shear by forming the plywood in an egg crate panel manner so that the major characteristics of plywood and panel shear are exploited in stressed skin panels with plywood webs which do not necessarily have to be interlocked in the egg crate manner. Thus, large flat stressed skin panels are provided which can be joined together to make larger panels by means which allows the same sort of shear resisting connection of intersecting panels at the joint at the edges. Where a building is made of a number of such panels, the joint method proposed involves an acoustic break which is highly desirable in reducing sound transmission from one part of the building to another. In this connection, the use of the egg crate core permits the connecting of panels edge to edge with an internal connection which does not show on the outside and which automatically allows the panels to get in one plane.

The panel is preferably made of structurally graded plywood components glued together using any structural timber adhesive but the face skins may be made of any composite board containing or largely composed of cellulosic fibers, as from timber, sugar cane etc. However the panel can also be made of fiber reinforced cementitious materials such as portland cement, gypsum, sulphur, etc. where a basic material is required that is either more fire resistant than plywood, etc. or which is less subject to variations in ambient moisture content or less prone to decay, insect attack and biodegradation. In such cases, as the fiber reinforced material can be adapted to cover a wide range of structural properties, depending on the nature of the fibers, the nature of the cement matrix and the method of manufacture, they would be most advantageously used where the allowable stresses in tension, compression, bending and shear for the fiber reinforced material are at least equal to or greater than those for structurally graded plywoods, and where the strength-to-weight ratio of the core members and skins and other characteristics of the materials do not nullify the advantages claimed for the timber based construction.

The means by which these claims are achieved, particularly when plywood is used are:

Considering a stressed skin panel, composed of two skins separated by a series of core members, it is known that the two skins are stressed primarily either in tension or compression, or partly in tension and partly in compression, dependent on the mode of support and the superimposed loads, while the core members can be taken as being primarily stressed in shear:

It can be shown, considering a single core member analysed as being the web of a simple beam the flanges of which are the width of the skins to a point halfway between the core member and the adjacent core members on either side, that it is advantageous for the core member if composed of a material capable of taking high shear stresses, to be very thin compared with the width of the flanges. However its thinness is limited both by the tendency to buckle due to the diagonal component of the shear force in the web, and by shear forces perpendicular to the plane of the web, caused by secondary stresses in the structure, which would cause the web to collapse sideways or shear at the junction of the web and flanges.

The tendency to buckle can be avoided if the ratio of the thickness of the web member to the diagonal measurement of its height taken at 45° to the vertical is less than 50. It is therefore advantageous to be able to adjust the thickness of the web independently of any other element in the panel, so that it is as close as possible to the ratio of 50 in order to achieve maximum economy.

The shear forces perpendicular to the plane of the web have, in previous known examples, usually been taken care of by making the web very thick at its junction with the flanges, either by using solid timber web members of rectangular section, or by molding such timber members to an approximate I section. A thin web member can be stiffened against collapse by bracing it transversely with similar thin sections placed at right angles at frequent intervals, and in the present invention this is done by employing the well known principle of an interlocking egg crate construction to brace the webs by a series of transversely placed webs placed at the same intervals as the primary webs. Use of the interlocking effect of egg crate construction permits greater ease of assembly by providing immediate stiffening of the whole plurality of webs in both directions before the adhesives have set, and also permits the transverse webs to absorb all of the secondary stresses due to shear perpendicular to the primary webs, and the primary shear stresses.

However, it is advantageous to consider such as stressed skin panel as acting according to the 'plate' theory, where the forces acting on the panel are not considered as acting only in one direction with respect to the panel, but as acting in a multitude of directions. This is especially advantageous when such a panel is subject to stresses during handling prior to incorporation into a structure, and when considering such a panel as part of structure subject to the many varying forces due to being transported from one place to another. It is also advantageous when considering the stresses due to warping tendencies, or due to moisture or temperature movements of the panel.

In accord with this consideration, it is desirable to have the core members acting in at least two directions at a substantial angle to each other, such as 90°, especially when it is accepted that the skins composing the flanges, whether of plywood or a material with more isotropic nature, are intrinsically capable of acting equal, or near equal strength in the two major directions of the panel plane. Hence it is preferred to consider both sets of webs as stress absorbing members, and to analyse the core as a two-directional shear core. This is achieved by having two sets of similar webs, spaced at intervals in one set corresponding to, or nearly to, the intervals in the other set, and by ensuring that these two sets coact at their intersections. To coact equally, it is necessary that one set be no more interrupted at the intersection than the other set, and such a condition can only be met by forming a slot in one set of exactly half the depth of the web, and a corresponding slot in the other set, both slots being of width corresponding to the width of the intersecting web. (This is, of course, the common egg crate assembly). To achieve maximum continuity, such an intersection is glued together on assembly, so that not only is there continuity of the horizontal shear forces in any one web member through the transverse web, but also the tendency for the vertical component of the shear forces to shear the web member at the slot is overcome by transferring the vertical shear stress via the glue line to the web of the transverse member.

Considering any structure which is desired to be transported it is advantageous to use in it materials which have a high strength-to-weight ratio. Of materials in this category, timber is known to have one of the highest such ratios, besides being the most commonly available, having the lowest initial cost, and being the most easily worked by common skills, In laminated form, such as plywood, its strength-to-weight ratio is further improved and is made more stable, and made more dependable with respect to moisture content, dimensions and evenness of structural properties.

It is also advantageous, when considering such transportable structures, to reduce the weight of each element by using such structural devices as stressed-skin panels, where each part of the element is used to its maximum structural advantage, and there is the minimum of structurally redundant material.

It is a particular claim of this invention that it uses a characteristic of plywood not previously exploited in stressed skin panels in order to achieve the maximum strength-to-weight of the entire structure, and made possible by the analysis of the way the shear forces in the web members are acting, as described above.

The limiting shear stress in plywood is usually taken to be that determined by what is termed the 'rolling shear' which occurs when one part of the shear force acts in the plane of one veneer, in the direction of its grain, and the other opposing part of the shear force acts in the next corresponding veneer, causing the fibers of the intervening transverse veneer to separate from each other in a rolling manner. The allowable shear stress in such circumstances is usually taken to be less than the allowable shear in solid timber sections of the same timber species.

However, when the shear forces acting in the plane of a plywood sheet can be said to be acting over the whole cross sectional area of the plywood, and not on individual veneers, the plywood is said to be acting in 'panel' shear for which the allowable stress is usually taken as being twice that of the allowable shear stress in solid timber of the same species, and three times as great as the allowable rolling shear stress in the same plywood. It is therefore clearly advantageous to use the plywood in such a manner that it is subjected to panel shear and not limited by rolling shear.

In previous known constructions, where an attempt has been made to use the panel shear characteristic of plywood, as by using plywood for the web members of beams, it has been found necessary to attach the plywood members to the flange members of the beams by glueing the flange members to the sides of the plywood webs. By such a method of attachment, rolling shear is caused in the plywood web over the area of attachment, due to the horizontal component of the shear force in the web. In the present invention, however, because the lateral stability of the plywood web is assured by the interlocking effect of the egg crate construction, it has been found possible to glue the plywood webs to the flanges, or skins, of the panel at their edges only, thus eliminating the possibility of rolling shear occurring in the webs.

Where the skin of the panel is made from plywood, it can be shown that rolling shear will occur in the plywood skin at the point of attachment to the webs, but it can also be shown that this will not limit the shear stresses allowable in the whole construction as long as the flange width corresponding to each web is more than three times the thickness of the web member. This is because the allowable stress in the panel shear is three times greater than the allowable stress in rolling shear for the same plywood. Hence it is advantageous for the web thickness in such a panel to be considerably less than the flange width appropriate to each web.

It should be noted that in earlier art which shows some form of egg crate assembly, with the core members fixed in some way to the skins, it is apparent that because of the nature of the thin skins, or the requirements of the pressing process, it has been necessary to maintain the web members relatively close together, and of substantial thickness in relation to the spacing. Hence, no attempt has been made to recognise the possibility of rolling shear occurring in the skins where these are of plywood.

Secondly, most of the earlier art is indifferent as to the nature of the material of the web members, particularly being quite silent on the shear stresses which might be encountered in such members. While some earlier art mentions use of plain timber sections, some describes the possibility of using such materials as foam rubber and corrugated cardboard which are shown to have very low shear resistance particularly in the direction parallel to the length of the web members. In this regard, it should be noted that paper honeycombs while giving the panel in which they are incorporated high shear strength in the direction perpendicular to the plane of the panel, have, because of their high buckling factors, very low shear strength in the directions parallel to the panel plane.

These points of view did not arise apparently because the panels which are subject of such art were primarily regarded as being structural only in a very minor manner, or because they were considered as panels subjected primarily to edge loading in their own plane, where the shear stresses in the plane of the panel were either very low or non existent.

Resistance of the core to press pressures in the present invention does not arise in the same way as it does in the normal hot pressing process used for door and furniture panels because in this invention, it is intended to apply pressure only directly over the lines of the ribs. The more sophisticated way of achieving this may well be the subject of a separate patent.

It is further relevant to note that much of the earlier art incorporating an egg crate type of core, was developed at times prior to the development of modern high strength adhesives for timber, and probably prior to the development of structurally graded plywoods. Hence such art envisages the use of casein and other low strength glues.

It is apparent that much of the strength of the present invention depends on the use of an adhesive at the junction of the web and flange members which is as strong, or stronger than the adhesion of the wood fibers to each other. Such adhesives are available and are now in common use, such as urea-formaldehyde adhesives. However, there is a further aspect of the invention which is intrinsic to its particular strength at the web flange junction:

It is known that timber, as in plywood veneer, consists of a large number of parallel fibers, consisting of bundles of fibrils, which may be characterised as being in effect, bundles of hollow tubes of various diameters. If adhesive is applied to the sides of these fibers, the bond obtained between the timber surface and the surface to which it is being glued is very strong: usually stronger than the bond between the fibers themselves. However, if adhesive is applied to the cut ends of the fibers, not only is the contact area of the ends of the hollow tubes clearly much less than that of the sides of the tubes, but also the adhesive tends to get drawn by capillary action into the tubes, extending the adhesive until it is too weak to be effective. Thus, application of the adhesive to the cut end of a veneer, rather than to its edge, will result in a far weaker bond.

As plywood is always made of an unequal number of veneers, in which the two veneers on the outside are parallel in fibre, or grain, direction and the next inner veneer or veneers have a fibre direction transverse to this, it follows that maximum adhesion to the edge of the plywood sheet is obtained when the edge being glued is parallel to the fiber direction or grain, of the face veneers.

Hence in the plywood webs of the present invention, the high bond strength of the web to the flange necessary is in part obtained by maintaining the face grain of the plywood webs parallel to the length of the webs, and to the plane of the flanges or skins. This ensures, that no matter how many veneers are used to make up the plywood used in the webs, that the greater number are glued with the sides of the fibers in contact with the flanges or skins of the panel, and that the shear stress is distributed symmetrically over the width of the web.

The content of the notes made above could be summarised by saying that the present invention consists in combining for the first time certain items of knowledge already known. These are:

Eggcrate assembly for thin webs
panel shear in plywood vs rolling shear
use of thin webs to carry shear as in rolled steel joists
plate action of a panel
high strength adhesion of timber
stressed-skin panel construction Of the four other aspects of the invention, there are:

a. the manner in which wall(or similar) panels can be attached to the edges of the structural panel by use of a trapezoidal anchor member in a perimeter slot b. the manner in which the structural panels can be joined edge to edge while automatically being aligned in the one plane, by use of trapezoidal or circular section keys inserted in the same perimeter slot as in (a)

c. the manner in which once such an edge to edge connection is made in the manner described in (b), the connection acts as a barrier to sound transmission by nature of the abrupt change in the size and cross section of the sound transmitting path It should be noted that (b) and hence (c) depend as much as anything on the fact that the panel is hollow, and that the interstices between the ribs are sufficiently large to enable bolts to be inserted via closable access holes, and tightened up.

The point which has not been made much of, and which perhaps deserves more attention is that the scale of the construction envisaged is much larger than that apparently envisaged in previous art.

Thus the invention envisages panel sizes much larger than would be apparent from the previous comparable art, but more importantly from the point of view of the intrinsic differences, it considers cell sizes of a much larger dimension and hence enables web thicknesses of ⅜ inch and upwards, which, while large enough to ensure good glueing area on the edges, are very thin compared with the cell size. Similarly the access holes for the bolts, which have to be in the order of 4 inches or 10 cm in diameter to enable a bolt, hand or tool to be inserted, are small relative to the cell size or the panel size, and hence do not have a marked effect in weakening the construction. Again, given the order of cell size considered, it is easy to consider the insertion of extra strengthening, such as a small area of a much smaller cell-size egg crate, or honeycomb into a particular cell where local resistance to punching shear is required. Similarly where it is desired to locally vary the web spacing or thickness of webs, this is made easier by the cell sizes and web thicknesses considered than it would be in a smaller scale use of the same egg crate construction.

The final aspect of the invention, which is the edge to edge jointing of the facing sheets is described in previous notes, and should be taken as a preferred alternative to the method described in the provisional specification for joining the facing sheets (the use of an applied strip of plywood over the joint either externally or internally).

Considering the portion of the construction considered as a beam as shown in FIGS. 10 and 11, where the total shear force is even throughout the depth of the construction the stress it causes in each part is inversely proportional to the cross sectional area of each part. Thus if a shear force is acting at right angles to the paper surface in the drawing i.e. the flange 34 has a much greater area, for example, 16 inches by ⅜ inch than the web 33 which has an area for example of 4½ inches by ⅜ inch. The result is that the shear stress in the flange is much less than the shear stress in the web. However, the shear stress can be absorbed by the web because its acting in the panel shear which is three times the shear strength that can be absorbed by the flange, which is acting in rolling shear so the higher shear stress caused in the web by a smaller area is cancelled out by its ability to absorb it. Thus as long as the flange width is three times the web thickness rolling shear in the flange is not the limiting factor. The allowable panel shear stress in plywood of any particular timber species is usually taken as twice that of the shear stress allowed for the timber as plain sawn lumber. It follows that allowable rolling shear is less than the normal shear stress in plain timber. (It is also worth noting that the allowable shear strength in particle board is less than the allowable rolling shear stress in equivalent plywood). Hence particle board webs have an allowable shear stress around a quarter of a plywood web. This arises through creep not initial strength. Thus comparing this construction with the normal stressed skin panel where the web is made of sawn timber, for example, an ex five inch by two inch glued to plywood skins three points made above relate.

a. the web, being of greater cross sectional area than the ply web, absorbs less of the shear stress, therefore putting more shear stress into the flanges, b. the flanges, which act in rolling shear, are limited by that to the amount of shear stress they can safely take far more than in the case of the plywood web, c. The allowable shear stress in the web, being only half that in the plywood web, does not compensate very well for the lesser shear stress it has to take, Another simplified way of looking at it, is that the glued contact area between the web and the skin is greater in the timber web than in the ply web, and hence the amount of 'pull' the timber web can exert on the inner veneer, causing it to roll on the other veneer, is greater than in the case of the plywood web, where the contact area is very narrow.

Hence, it can be said, somewhat roughly, that the greater strength of the plywood web, plus the fact that it is narrow compared with the spacing of the webs, (i.e. the width of the flanges) makes the construction in plywood webs much stronger that construction with timber webs.

Figure 30:
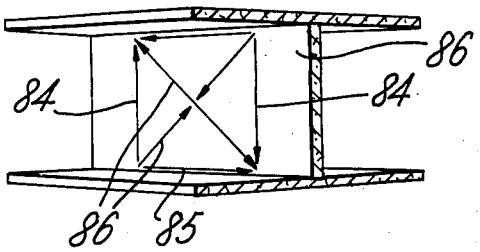
FIG. 30 is an isometric view of a beam forming part of a panel showing forces acting.

Given that, the question that next arises is how thin can the webs become. Clearly, the limitation is the point at which the stresses in them cause them to buckle. The limit is derived from the shear stresses shown in FIG. 30 which shows stresses acting both vertically 84 and horizontally 85 in the web 86. The vertical stress is the same as the horizontal one, and the result is a diagonal stress in the plane of the web. This taken as acting at precisely 45°.

We then apply the basic rule that a column or thin plane will buckle if the ratio of the thickness to the length is greater than 50. For a ⅜ inch thick web, the limit is 17 inches approx, so the diagonal measurement of the web should not be greater than 17 inches. That gives a web height of 12 inches before buckling will occur under the diagonal compression induced by the two sets of opposing shear forces in the web. Of course, if we ever required to exceed 12 inches depth we simply thicken the web, and a new limit applies.

However, although this shows that in the current construction the web is very under stressed as far as buckling goes, it does show that very thin webs, such as in paper honeycombs or steel would buckle very easily in the sort of dimensions we are working in. Thus, to take advantage of the high shear stress allowed in sheet steel, the depth of a stressed skin panel using a steel web would be very thin. However, it can be postulated that another material with as high a shear stress allowed as panel shear in plywood, and of comparable thickness and weight etc. would also make a very good panel web. There is a distinct possibility that this would occur with one of the fiberglass reinforced cements (including portland cement, gypsum, sulphur calcium silicate etc.).

As far as using timber or timber products are concerned, which have a high strength-to-weight ratio, plywood webs are far better than anything else we know of. On the other hand, the skins provided that they can be glued to the web edges and provided that their allowable shear strength is equal to or greater than the allowable rolling shear in plywood, (and their compressive and tensile strengths are also equal) can be any material at all. However, as particle board does not comply, and, as far as we know hardboard does not comply, plywood skins remain the best available sheet material made from timber. On the other hand, while the stresses in the skins are kept to their present low limits, particle board and probably hardboard, are both possible contenders where they have some other advantage, such as finish.

Finally the remaining problem is what effect do the cross ribs have on the construction. Three important points may be made.

There is a valid point in the increase in allowable stresses due to glueing the web on all four edges as against just two. Glueing of the intersection of the webs will greatly strengthen the construction. By doing this panel shear will be developed in the cross ribs as well, where they could be said to be limited by rolling shear at the point of intersection. Also, such glueing will overcome the weakness in the ribs caused by the slots.

The cross webs take care of secondary stresses, minimising them, and allow the whole panel to be analysed as a 'plate' rather than in simple beam theory.

If the panel is analysed as a plate, the stresses taken to be acting can be drastically reduced. Thus in the floor panel analysis if taken as a two way slab all stresses are halved.

When bending stresses are considered the plywood flange in compression has a length of 144 inches width 16 inches, thickness ⅜ inch. This gives $L/t = ((144)(8)/(3)) = 384$ inches. The flange could buckle but if the flange is supported at each 16 inches by the cross web of the core the unsupported flange length becomes 16 inches and being continuous this reduces to $(16)(8)/10 = 13$ inches and $L/t$ becomes $(13)(8)/3 = 35$ a factor which makes the flange safe against buckling.

For general purposes the construction envisaged herein are preferably limited to a minimum of 12 inches cell width with ⅜ inch webs, but can go as high as the equivalent of ⅜ inch webs with a height of 12 inches before buckling occurs in the webs, and for a skin thickness of ⅜ inch a cell width of 21 inches is possible before buckling occurs in the skin. The core members and skins may be of fiber reinforced cementitious materials.

Glueing is only one alternative form of bonding which may be used.

We claim:

1. A structural building panel serving for the whole floor or roof of at least one room, comprising a pair of continuous skins and a core, said skins including a plurality of sheets of suitable material bonded edge to edge, said core including a plurality of strips of suitable material positioned such that the edges of each strip are fixed one to each skin, said strips being arranged in two sets, with each strip in each set being substantially parallel with each other and each set being arranged to lie at a suitable angle to the other set, the strips of each set having a notch extending to one-half the depth of the strip at the points of intersection with the strips of the other set, the weakness of the panel due to said notches being overcome by spacing the strips in each set relative to the depth of each strip at a minimum ratio of 2:1, the weakness of the panel due to the tendency of the strips to buckle being overcome by spacing the strips in each set relative to the thickness of each strip at a maximum ratio of 60:1, and the weakness of the panel due to the tendency of the skin to buckle being overcome by spacing the strips in each set relative to the thickness of the skin at a maximum ratio of 60:1.

2. The structural building panel as claimed in claim 1 having side and end frame members and internal reinforcing members, in which the loads are transferred from the side and end frame members to support points inset from the side and end frame members by means of the internal reinforcing members disposed on either side of any one strip coincident with any said support point and extending therefrom transversely to the side and end frame members, and in which any said bisecting member may be viewed as an internal reinforcing member.

3. The structural building panel as claimed in claim 1, in which said strips are plywood strips composed of an unequal number of veneers, and being so disposed that the outer veneers in each said strip have their grain parallel with the skin to which it is fixed.

4. The structural building panel as claimed in claim 1, in which the intersections between intersecting strips are bonded.

5. The structural building panel as claimed in claim 1, in which said core and skins are of fiber reinforced cementitious materials.

6. The structural building panel as claimed in claim 1, in which said skins comprise sheets of fiber reinforced cementitious material bonded to said core.

7. The structural panel as claimed in claim 1, in which said panel is provided with side and end frame members, and with the ratio of the longer side to the shorter side of said panel being greater than 1:1, said panel being provided with bisecting frame members to divide the core member into two core members having a ratio of the longer to the shorter side of not more than 3:2.

8. The structural building panel as claimed in claim 7, in which said side and end members are profiles of suitable thickness composed of fiber reinforced cementitious materials, and at least some of which have a trapezoidal groove longitudinal of the outer faces.

* * * * *